United States Patent [19]

Ericson et al.

[11] 4,318,578

[45] Mar. 9, 1982

[54] ELECTRICAL CONNECTOR WITH GROUND FAULT DETECTOR

[75] Inventors: John E. Ericson, Moreland Hills; Earl Mahnke, Eastlake, both of Ohio

[73] Assignee: The Ericson Manufacturing Company, Willoughby, Ohio

[21] Appl. No.: 113,534

[22] Filed: Jan. 21, 1980

[51] Int. Cl.[3] ..... H01R 13/717

[52] U.S. Cl. ..... 339/14 P; 339/113 L; 339/147 P

[58] Field of Search ..... 339/14 P, 113 R, 113 L, 339/195 M, 196 M, 62, 63, 147 P, 206 P; 340/649, 656

[56] References Cited

U.S. PATENT DOCUMENTS

| | | | |
|---|---|---|---|
| 2,034,273 | 3/1936 | Smith | 339/113 |
| 2,731,629 | 1/1956 | Siderman | 339/157 C |
| 3,258,635 | 6/1966 | Carothers et al. | 315/36 |
| 3,890,030 | 6/1975 | McDaniel | 339/147 P |
| 3,924,914 | 12/1975 | Banner | 339/14 P |
| 4,021,092 | 5/1977 | Ericson, Jr. | 339/103 R |
| 4,058,764 | 11/1977 | Kirchoff | 340/649 |
| 4,111,516 | 9/1978 | Wireman | 339/14 P |
| 4,118,690 | 10/1978 | Paynton | 339/14 P |

FOREIGN PATENT DOCUMENTS

| | | | |
|---|---|---|---|
| 2061437 | 6/1972 | Fed. Rep. of Germany | 339/113 L |

*Primary Examiner*—John McQuade

*Attorney, Agent, or Firm*—Yount & Tarolli

[57] ABSTRACT

Disclosed is an electrical connector which includes a ground fault detector and indicator. The detector is incorporated in a modular construction which is easily and conveniently mounted within the housing of the connector and may be easily replaced in the event of failure. Visual indication of proper connection and grounding is provided by a plurality of windows disposed circumferentially around the housing.

10 Claims, 6 Drawing Figures

ELECTRICAL CONNECTOR WITH GROUND FAULT DETECTOR

BACKGROUND AND SUMMARY OF THE INVENTION

This invention relates to the art of electrical connectors which include a means for detecting and indicating proper grounding of an electrical device.

Various types of electrical connectors with ground fault detectors are known. These connectors incorporate rudimentary detector circuits generally including only a resistor and/or diode and a neon lamp. One type includes a detector circuit and indicator lamp mounted on a separate plate or body which establishes electrical contact intermediate various portions of the connection such as between a plug and a wall socket. Connectors and indicators of this type are described in U.S. Pat. Nos. 2,449,150 and 3,753,261.

Another type of ground fault and circuit continuity detector comprises a plug to be received within a receptacle which provides only means for indication of proper contact and grounding of the receptacle rather than acting as an electrical connector for an external device. Detectors of this type are described in U.S. Pat. Nos. 2,997,701; 3,383,588; and 4,166,242.

A third type comprises an electrical connector in which a ground fault detector and indicator circuit is incorporated directly into the electrical connector. Electrical contact is made between the various portions of the electrical connector and a circuit to provide a visual indication of proper connection and grounding. This type of connector may also incorporate means for disconnecting circuit continuity when proper connection and grounding is not effected. Visual indication is provided by a lamp mounted on the exterior of the connector body. Thus, the visual indication is provided in a directional manner which may be shielded from view by connector orientation or other external physical obstructions near the connectors. Connectors of this type are described in U.S. Pat. Nos. 3,171,113; 3,659,152; 3,873,951; and 3,924,914.

The present invention provides a new and improved electrical connector with ground fault detector. In accordance with the invention, the electrical connector comprises a housing including means for establishing electrical connection such as with contact blades in a plug or receptable contacts in a socket. A conductor cable extends within the housing and connected to the contact means and an integral, modular ground fault detector circuit and indicator mounted within the housing. The housing includes a plurality of radially disposed windows which are adjacent the indicator to provide a circumferential visual indication of the properly connected contact circuitry.

As used in this specification, the term "ground fault detector" will be understood to include detectors for sensing improper connection of the "hot" and "neutral" leads of an electrical circuit as well as fault in the ground connection.

Further in accordance with the invention, the ground fault detector and indicator circuitry is incorporated in a modular unit which is easily mounted within the housing and is readily replaceable in the event of failure. Advantageously, the electrical connection between the connector and the ground fault detector circuitry is established through a resilient contact means so that replacement of a defective ground fault detector module is easily effected without the necessity of time consuming assembly procedures such as soldering. It is thus unnecessary to dispose of the entire electrical connector if there is merely a failure of the detector circuit.

BRIEF DESCRIPTION OF THE DRAWINGS

The foregoing and other features and objects of the invention will become apparent upon a consideration of the accompanying drawings forming a part of this specification and in which.

DETAILED DESCRIPTION OF A PREFERRED EMBODIMENT AND DRAWINGS

Figure 1:
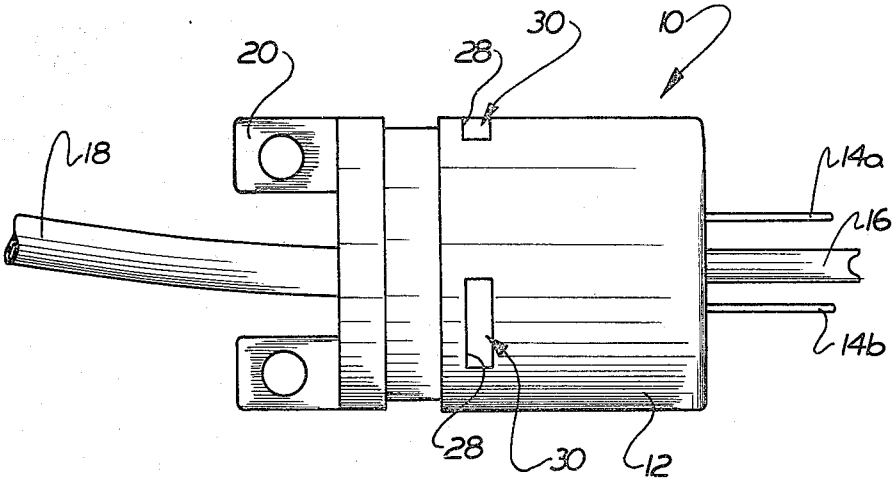
FIG. 1 is a side elevational view of one form of electrical connector incorporating a ground fault detector and circumferential visual indicator module in accordance with the present invention.

FIG. 1 shows a preferred form of electrical connector in accordance with the invention. Thus, a plug 10 has a housing body 12 includes a pair of blade-form contact prongs 14*a* and 14*b*. A ground contact blade 16 is also provided to comprise a generally standard three-prong, grounded plug. A three-wire conductor 18 extends into the body of the housing 12 and contact with the individual conductor wires is made to the contact prongs 14*a* and 14*b* and the ground contact blade 16 as described hereinafter. A clamping means 20 which is generally conventional in the art is provided to hold the three wire conductor 18 in position relative to the plug 10.

In accordance with the invention, a plurality of window openings 28 are provided around the periphery of the plug body 12 extending into the hollow interior thereof. A portion of a ground fault detector and indicator module 30 extends into window openings 28 in accordance with a preferred form of the invention.

The invention will be described in relation to a plug form electrical connector. It will also be understood that other types of electrical connectors such as electrical sockets, screw type connectors or any similar form of electrical connector may utilize a ground fault detector and indicator module in accordance with the features of the present invention. Further, while a three-wire electrical conductor will be described herein, it will be understood that other combinations are possible, such as a four-wire conductor which effects positive grounding of a housing for an electrical device associated with the connector.

Figure 2:
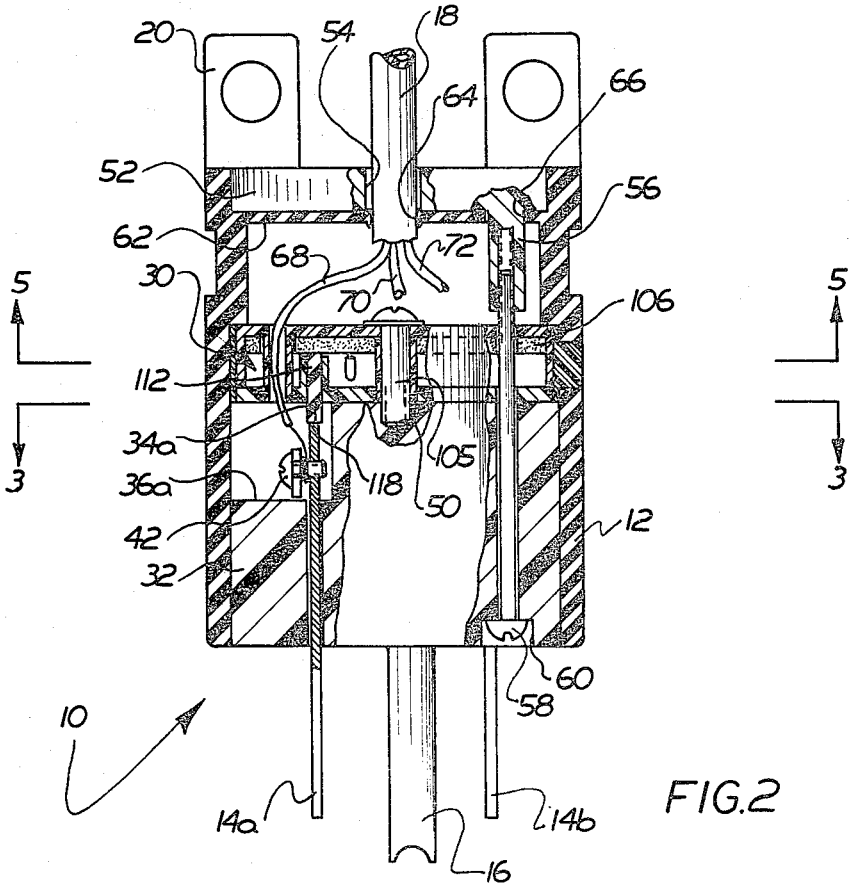
FIG. 2 is an enlarged fragmentary side elevational view of the connector shown in FIG. 1 showing the relationship of various components of the connector within the body of the housing.

FIG. 2 illustrates the components of the electrical connector within the housing 12. For convenience, the plug 10 is shown in a generally cylindrical form, although it will be understood that the invention is not limited to a cylindrical-shaped electrical connector. The connector may take other forms such as triangular, rectangular or an irregular form within the scope of the invention.

Figure 3:
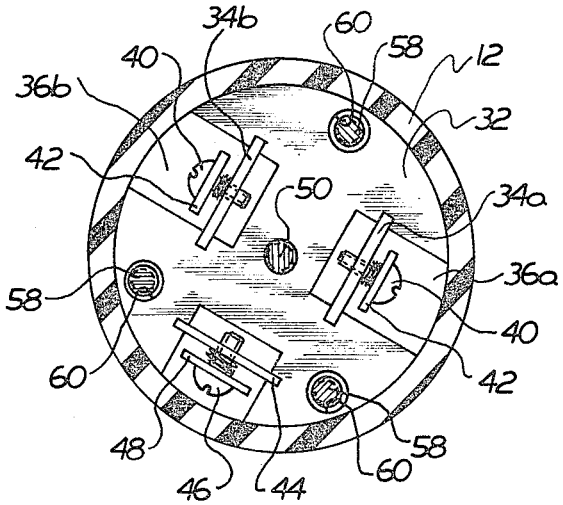
FIG. 3 is a plan view of a portion of the electrical connector taken along lines 3—3 of FIG. 2.

Contact prongs 14*a* and 14*b* and ground contact blade 16 are assembled in and pass axially outwardly from a generally solid mounting body 32. As illustrated in FIGS. 2 and 3, the inward end 34*a* of connector contact prong 14*a* is located within a recess 36*a* in mounting body 32. In a similar manner, the inward ends of ground contact blade 16 and prong 14*b* are positioned with similar recesses 38, 36*b*, respectively, in mounting body 32.

Each of these inward ends, such as inward end 34*a* of the contact prong 14*a*, includes a connection screw 40 and a clamp assembly 42 for securing a conductive lead wire in electrical contact with the contact prongs 14*a*, 14*b*. In a similar manner, inward end 44 of ground contact blade 16 includes a screw 46 and clamp assembly 48 for connecting a ground lead wire thereto.

A mounting hole 50 is located centrally on the mounting body 32 and extends axially. The function of the mounting hole 50 is that of positioning and securing the ground fault detector and indicator module 30 in accordance with the invention and will be described more fully hereinafter.

A clamping and assembly body 52 is located axially opposite mounting body 32 on the opposite end of the housing 12. Three-wire conductor 18 is positioned to pass axially through central opening 54 in the clamping and assembly body 52. The three-wire conductor 18 is held in position relative to the clamping and assembly body 52 by clamping means 20 which may take any form but is preferably that described in U.S. Pat. No. 4,021,092.

A plurality of hollow shafts 56 are located on the inward side of clamping and assembly body 52 and extend parallel to the axis of the housing 12. These hollow shafts 56 perform two functions in the assembly of the connector 10. First of all, an assembly screw 58 passes through an opening 60 in mounting body 32 upwardly through the interior of the housing 12 and into each of the hollow shafts 56 thereby securing the assembly into a unitary structure. Commonly, three of such assembly screws 58 are received in three separate hollow shafts 56 in clamping and assembly body 52.

Three-wire conductor 18 passes through central opening 54 of clamping and assembly body 52 as previously described. The conductor 18 then passes through a resilient web 62 formed on the housing 12 which extends as a moisture barrier across the interior of housing 12. An opening 64 is provided for receiving conductor 18 therethrough. Similarly, a plurality of openings 66 are provided so that hollow shafts 56 may pass therethrough. Three-wire conductor 18 is divided to separate each of the three conductor wires 68, 70 and 72 respectively within the body of the housing 12. Each of the wires is led to the inward ends of its appropriate contact prong 14*a*, 14*b* or ground contact blade 16 and is secured thereto with the appropriate screw and clamp assembly.

Figure 4:
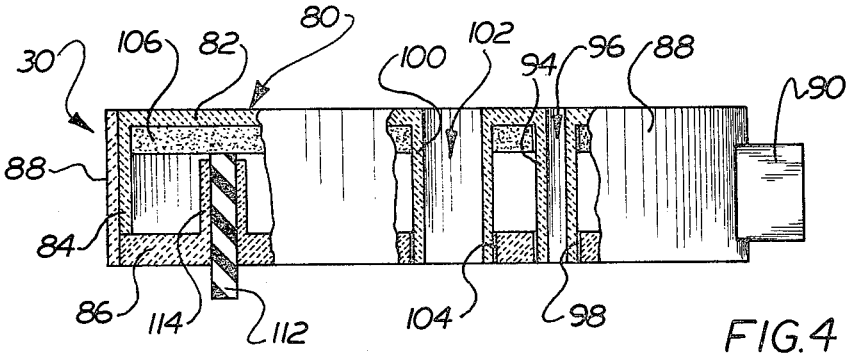
FIG. 4 is a fragmentary side elevational view of a ground fault detector and indicator module in accordance with a preferred embodiment of the invention.
Figure 5:
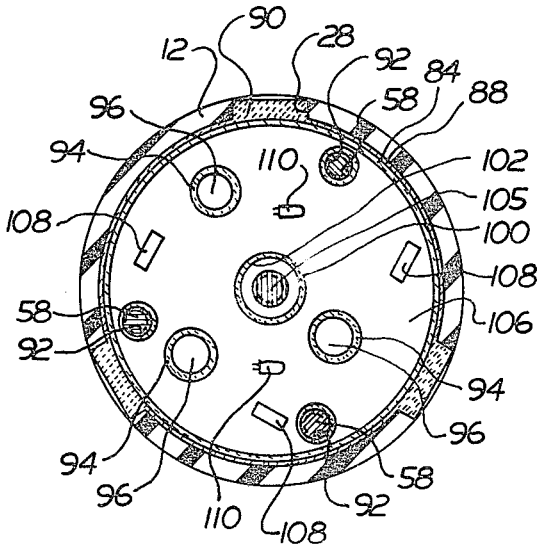
FIG. 5 is a plan view of a portion of the electrical connector shown in FIG. 2 taken along lines 5—5 thereof.

FIGS. 4 and 5 illustrate the modular, unitary ground fault detector and indicator module 30 in accordance with a preferred embodiment of the present invention. The module 30 generally comprises a support structure including a cup-shaped hollow body 80 having a base 82 and cylindrical side wall 84. A cover plate 86 extends across the open end of sidewall 84 opposite base 82. Both the cover plate 86 and cup-shaped hollow body 80 are formed from a transparent material such as clear polyethelene or PVC.

A clear annular diffuser ring 88 is mounted so as to circumscribe cylindrical side wall 84 and includes a plurality of outwardly extending ears 90 which correspond in number, position, and size to window openings 28 in housing 12 of the electrical connector. In the preferred embodiment shown in the drawings, there are three such ears 90 extending through window openings 28 which are disposed radially around the periphery of housing 12 at 120° intervals. It will be understood that other numbers and dispositions of windows may be provided within the scope of the invention so long as a circumferential indication of proper connector operation is achieved.

Hollow body 80 incorporates a number of openings having various functions. Thus, a plurality of screw openings 92 are located around the periphery of base 82 of the hollow body 80 which permit passage of screws 58 through the module 30. Similar screws holes (not shown) are provided in alignment with screw holes 92 in cover plate 86 for the same purpose.

Three conductor wire shafts 94 having openings 96 therethrough are formed in the base 82 of hollow body 80 and extend axially parallel to cylindrical side wall 84. Each of the shafts 94 aligns with an opening 98 in cover plate 86 so that conductor wires 68, 70 and 72 will be electrically insulated from and pass axially through the module 30.

In a similar manner, base portion 82 of hollow body 80 includes an assembly shaft 100 having opening 102 positioned centrally on hollow body 80 and extending axially parallel to cylindrical side wall 84. Opening 102 is in alignment with a central opening 104 in cover plate 86 so that a central passage through the module 30 is provided. This central passage receives module mounting screw 105 (FIGS. 2 and 6) therethrough in the assembly of the plug 10.

A printed circuit board 106 is positioned within the module 30 adjacent the base 82 of hollow body 80. The circuit board 106 is generally a flat, disc-shaped body and includes all the necessary openings for interfitting around screw holes 92 and the shafts 94 and 100 so that it may lie adjacent the base 82 of the hollow body 80 within the interior thereof. The printed circuit board 106 includes three contact plates 108 wherein electrical contact is made with the circuitry of the circuit board 106.

Circuit board 106 is preferably made of a ceramic material and has the necessary circuitry for a ground fault detector associated therewith. The ground fault detector circuit may be of any type common in the art of ground fault detectors but is more preferably a circuit of the type described in co-pending Application Ser. No. 103,460, filed Dec. 14, 1979, which is assigned to the assignee of this invention.

The ground fault detector circuitry includes at least one and preferably at least two indicator lamps 110 which are mounted on the circuit board 106 to provide a visual indication of proper functioning and connection of the detector circuitry.

Electrical contact is made between each of the contact plates 108 and one of the contact prongs 14*a* and 14*b* and ground contact blade 16 through a resilient, compressible contact pad 112, each of which is positioned axially within a corresponding shaft 114 in the cover plate 86 of module 30. Resilient contact pads 112 may take any form but are preferably rectangular in shape and shafts 114 correspond in shape to resilient contact pads 112.

As clearly seen in FIG. 2, resilient contact pad 112 extends between circuit board 106 and end portion 34*a* of contact blade 14*a*. Resilient contact end portion 118 is in abutting engagement with end portion 34*a* and establishes electrical contact from contact prong 14*a* to circuit board 106 when the module 30 is in its properly assembled position within the housing 12 of plug 10.

Resilient contact pad 112 is slightly longer than the distance between the surface of circuit board 106 and the end portion 34*a* of contact prong 14*a* when the module 30 is in the mounted position. Thus, the resilient contact pad 112 is in axial compression against both contact points. It will be understood that contact with the other contact prong 14*b* and the ground contact blade 16 is essentially identical to that illustrated for the contact prong 14*a*.

Resilient contact pad 112 is preferably made of a conductive rubber material such as polyurethane foam, etc., with conductive particles of iron, copper or the like, dispersed within the polymer matrix. It will be understood that other forms of resilient contact members are possible and contemplated within the scope of the invention.

It can clearly be seen from the above that ground fault detector module 30 may be easily replaced should it fail for any reason. It would not be necessary to dispose of the entire plug 10 due to failure of only the ground fault detector and indicator module 30. This results in substantial savings for the user.

Figure 6:
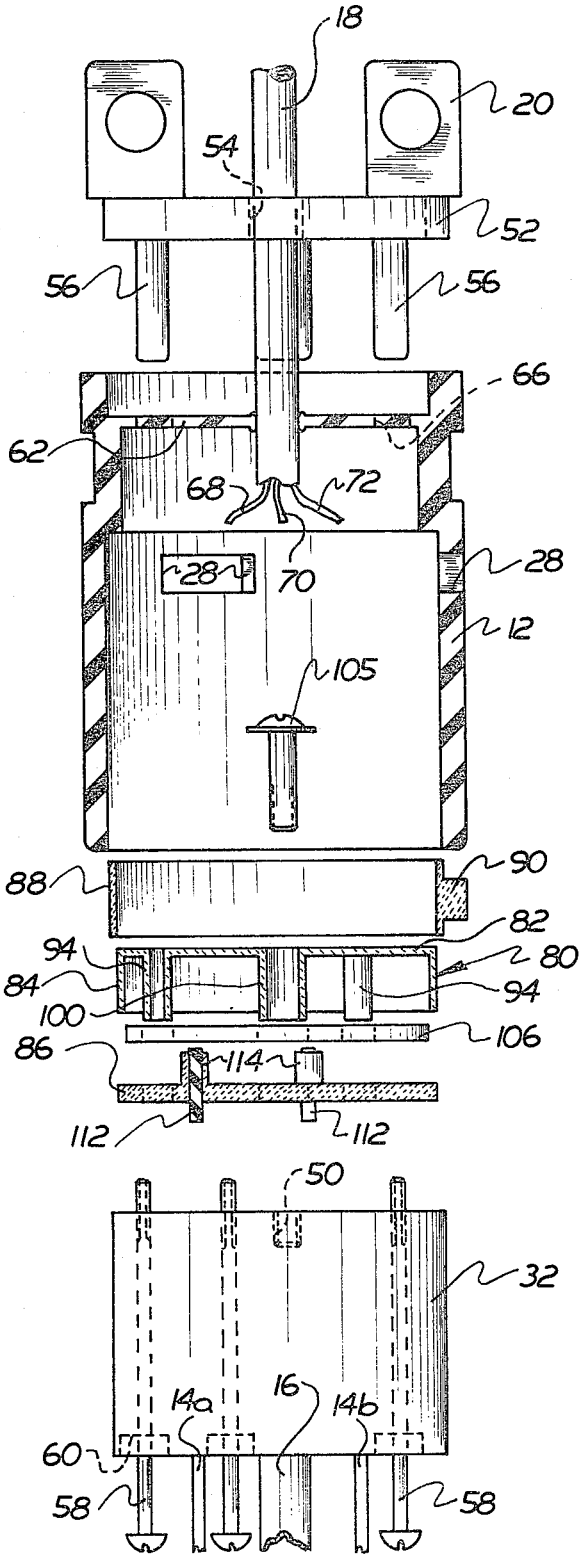
FIG. 6 is an exploded, partially fragmented, side elevational view of the components of a preferred form of electrical connector illustrating the method of assembly thereof.

The assembly of the electrical connector 10 is illustrated in FIG. 6. The ground fault detector module 30 is assembled by positioning circuit board 106 adjacent base 82 within hollow body 80. Cover plate 86 is positioned along the open end of hollow body 80 and diffuser ring 88 is mounted so as to circumscribe the entire assembly. The module 30 is then positioned over mounting hole 50 on mounting body 32 and is secured thereto by module mounting screw 105. Resilient contact pads 112 are compressed between contact plates 108 on circuit board 106 and the respective end portions 34*a*, 34*b*, 44 of the prongs 14*a*, 14*b* and ground contact blade 16, respectively.

Each of the electrical conductor wires and ground wire 68, 70 and 72 are passed through the appropriate shafts 94 in ground fault detector and indicator module 30 to the mounting body 32 where they are appropriately attached by means of the screws and clamps previously described to make electrical contact with contact prongs 14*a*, 14*b* and ground contact blade 16.

The housing 12 which is made of a resilient rubberlike material is then stretched so that mounting body 32 and ground fault detector module 30 may be pressed into the interior thereof. Ears 90 of diffuser ring 88 extend outwardly through windows 28 of the housing 12 when the mounting body 32 and connected ground fault detector module 30 are properly positioned within the housing 12. Clamping and assembly body 52 is pressed into position at the top of housing 12 and hollow shafts 56 pass through openings 66 in web 62 to a position adjacent the base 82 of the hollow body 80.

Screws 58 are then passed through the assembly into hollow shafts 56 to secure the entire structure. A cable clamp 20 of the type previously described is then secured around the cable 18 to complete the assembly of the connector.

While the invention has been described in the more limited aspects of a preferred embodiment thereof, other embodiments have been suggested and still others will occur to those skilled in the art upon a reading and understanding of the foregoing specification. It is intended that all such embodiments be included within the scope of the invention as limited only by the appended claims.

What is claimed is:

1. An electrical connector for cooperating with a second electrical connector to complete a circuit therebetween, said electrical connector comprising:

a housing including at least first and second pieces assemblable into a closed housing having a chamber therein, and disassemblable to expose said chamber, and first electrical contacts accessible from said chamber and adapted to cooperate with contacts of the cooperating second electrical connector to complete said circuit therebetween;

a unitary ground fault detector and indicator assembly adapted to fit in said chamber of said housing, said assembly including a support member enclosing a lamp and circuitry for causing the lamp to light in response to proper grounding, and further including a plurality of contact means connected to said lamp and circuitry and adapted to contact said first electrical contacts; and means for removably securing said unitary assembly within said housing and for effecting electrical contact between said first contacts and said contact means when said unitary assembly is assembled in said housing, whereby said ground fault detector assembly may be readily removed for replacement by disassembly of said housing.

2. The electrical connector as set forth in claim 1 wherein said plurality of contact means comprises a plurality of resilient conductive means for forming a resilient electrical connection between said first contacts and said lamp and circuitry upon securing of said unitary assembly in said housing, whereby the connections are automatically made without separate manual connecting operations.

3. The electrical connector as set forth in claim 1 in which said housing includes a plurality of windows opening into said chamber and said support member is transparent and is located adjacent said windows so that when said lamp is lighted, a visual indication of proper grounding is apparent outwardly of said housing.

4. The electrical connector as set forth in claim 3 wherein said plurality of windows are disposed peripherally around said housing at regular intervals.

5. The electrical connector as set forth in claim 1 wherein said ground fault detector and indicator circuitry comprises a printed circuit board including said lamp.

6. An electrical connector for cooperating with a second electrical connector to complete a circuit therebetween, said electrical connector comprising a housing defining a chamber therein, first electrical contacts located in said chamber and adapted to cooperate with contacts of the cooperating second electrical connector, a ground fault detector and indicator which includes a plurality of contact means for electrically connecting said ground fault detector and indicator with said first contacts, a lamp and circuitry for causing the lamp to light in response to proper grounding, said ground fault detector and indicator comprising a modular construction including a support member for supporting said lamp, said plurality of contact means and said circuitry as one unitary assembly, and means for securing said unitary assembly within said housing and for effecting electrical contact between said first contacts and said circuitry of said unitary assembly through said contact means when said unitary assembly is assembled in said housing, wherein said plurality of contact means comprise a plurality of resilient conducting means including a plurality of resilient conductive rubber pads.

7. An electrical connector for cooperating with a second electrical connector to complete a circuit therebetween, said electrical connector comprising a housing defining a chamber therein, first electrical contacts located in said chamber and adapted to cooperate with contacts of the cooperating second electrical connector, a ground fault detector and indicator which includes a plurality of contact means for electrically connecting said ground fault detector and indicator with said first contacts, a lamp and circuitry for causing the lamp to light in response to proper grounding, said ground fault detector and indicator comprising a modular construction including a support member for supporting said lamp, said plurality of contact means and said circuitry as one unitary assembly, and means for securing said unitary assembly within said housing and for effecting electrical contact between said first contacts and said circuitry of said unitary assembly through said contact means when said unitary assembly is assembled in said housing, wherein said contact means for electrically connecting said ground fault detector and indicator with said first contacts comprises a plurality of resilient, polymeric, electrically conductive pads located in said support member and compressed between said first contacts and said circuitry of said ground fault detector and indicator.

8. The electrical connector as set forth in claim 7 wherein said means for securing includes at least one screw member passing through said unitary assembly to locate said unitary assembly within said housing and compress said pads.

9. An electrical connector comprising a housing having at least one side wall defining an interior space therewithin, conductor means for carrying an electrical current relative to said connector disposed within said interior space of said housing and extending outwardly therefrom, said conductor means terminating within said housing at a plurality of connector contact means for establishing electrical connection with another electrical connector, said conductor means further including a ground wire terminating at a ground connector contact, said housing including at least one window disposed along said side wall, said window opening into said interior space of said housing, a ground fault detector means disposed within said housing for detecting a connection error with respect to said connector, said detector means including means for providing a visual indication of the detected connection error, said means for providing said visual indication being disposed adjacent said window of said housing, said detector means comprising a replaceable, unitary, modular structure mounted within said housing and a plurality of resilient connector means for establishing electrical contact between said detector means and each of said plurality of connector contact means and said ground connector contact.

10. An electrical connector comprising a housing having at least one side wall defining an interior space therewithin, conductor means for carrying an electrical current relative to said connector disposed within said interior space of said housing and extending outwardly therefrom, said conductor means terminating within said housing at a plurality of connector contact means for establishing electrical connection with another electrical connector, said conductor means further including a ground wire terminating at a ground connector contact, said housing including at least one window disposed along said side wall, said window opening into said interior space of said housing, a ground fault detector means disposed within said housing for detecting a connection error with respect to said connector, said detector means including means for providing a visual indication of the detected connection error, said means for providing said visual indication being disposed adjacent said window of said housing, said detector means comprising a replaceable, unitary, modular structure mounted within said housing and a plurality of resilient connector means for establishing electrical contact between said detector means and each of said plurality of connector contact means and said ground connector contact, wherein said plurality of resilient connector means includes a plurality of resilient, conductive rubber pads.

* * * * *